US006408730B1

(12) United States Patent
Tinner et al.

(10) Patent No.: US 6,408,730 B1
(45) Date of Patent: Jun. 25, 2002

(54) SEPARATING DEVICE WITH CUTTING CHAIN FOR PROCESSING SANDWICH PANELS

(75) Inventors: Andreas Tinner, Igis; Matthias Accola, Fanas, both of (CH)

(73) Assignee: Trumpf GmbH & Company, Ditzingen (DE)

( * ) Notice: Subject to any disclaimer, the term of this patent is extended or adjusted under 35 U.S.C. 154(b) by 0 days.

(21) Appl. No.: 09/530,229

(22) PCT Filed: Aug. 19, 1999

(86) PCT No.: PCT/EP99/06067

§ 371 (c)(1),
(2), (4) Date: Jul. 3, 2000

(87) PCT Pub. No.: WO00/10782

PCT Pub. Date: Mar. 2, 2000

(30) Foreign Application Priority Data

Aug. 15, 1998 (DE) ..... 298 15 228 U

(51) Int. Cl.[7] ..... B27B 33/14

(52) U.S. Cl. ..... 83/832; 83/168; 83/100; 83/788; 30/376; 30/381

(58) Field of Search ..... 30/381, 382, 374, 30/375, 376, 377; 83/788, 835, 837, 839, 851, 855, 168, 100, 832

(56) References Cited

U.S. PATENT DOCUMENTS

| | | | | | |
|---|---|---|---|---|---|
| 1,276,579 | A | * | 8/1918 | Scott | 30/382 |
| 1,557,238 | A | * | 10/1925 | Boerner | 30/381 X |
| 2,296,240 | A | * | 9/1942 | Blum | 30/382 X |
| 2,800,153 | A | | 7/1957 | Barth | |
| 3,124,179 | A | | 3/1964 | Cavero | |
| 3,587,679 | A | * | 6/1971 | Conte | 30/381 |
| 3,845,556 | A | * | 11/1974 | Edmunson | 30/381 |
| 3,910,147 | A | * | 10/1975 | Heyerdahl | 30/381 X |
| 4,063,358 | A | * | 12/1977 | Hodge | 30/382 X |
| 4,309,931 | A | | 1/1982 | Alexander | |
| 4,773,160 | A | * | 9/1988 | Wold | 30/381 X |
| 4,807,366 | A | * | 2/1989 | Masato et al. | 30/381 X |
| 5,077,896 | A | * | 1/1992 | Rivera | 30/381 X |
| 5,321,890 | A | * | 6/1994 | LaBlue | 30/381 X |
| 5,570,512 | A | * | 11/1996 | Hoppner | 30/381 X |

FOREIGN PATENT DOCUMENTS

| | | | | | |
|---|---|---|---|---|---|
| CH | 226499 | | * | 4/1943 | 30/381 |
| DE | 75100 | | | 4/1893 | |
| DE | 237687 | | | 8/1911 | |
| DE | 550534 | | * | 4/1932 | 30/381 |
| DE | 3739414 | A1 | | 5/1988 | |
| DE | 3890682 | T1 | | 8/1989 | |
| DE | 9102288.6 | | | 6/1991 | |
| DE | 19531450 | A1 | | 2/1997 | |
| DE | 4237781 | C2 | | 8/1998 | |
| FR | 2610563 | | * | 8/1988 | 30/381 |

* cited by examiner

*Primary Examiner*—Charles Goodman
(74) *Attorney, Agent, or Firm*—Pepe & Hazard LLP

(57) ABSTRACT

A cutting device for tooling sandwich plates has as its cutting tool a cutting chain (5) with cutting elements in the form of chain links (27, 28, 29) and a chain guide as the guide mechanism, wherein the chain links (27, 28, 29), lying one behind the other in their direction of movement (23), can swivel relative to one another on a swivel axis running transverse to their plane of movement and are moved by means of the chain guide in the plane of movement sometimes in a straight line, sometimes in a curve. The chain links (27, 28, 29) also have several cutting teeth (34) lying one behind the other in their direction of movement (23), which project radially on the cutting chain (5) and have cutting edges (335), which run transverse to the plane of movement of the chain links (27, 28, 29), wherein the perpendicular projections of the cutting edges (35) are arranged in the plane of movement at least partially along a line curved radially to the outside. The cutting chain (5) of the cutting device has the type of chain links (27, 28, 29) described above.

16 Claims, 5 Drawing Sheets

SEPARATING DEVICE WITH CUTTING CHAIN FOR PROCESSING SANDWICH PANELS

BACKGROUND OF THE INVENTION

The invention concerns a cutting device for tooling sandwich plates with a motor-driven cutting tool that can move in the cutting direction relative to the sandwich plate being tooled and has a cutting element moved by means of a guide mechanism in a plane of movement that runs transverse to the plane of the plate.

Sandwich plates are multilayer workpieces whose individual layers are not uniform in mechanical strength. They are generally composed of a foam core and cover layers on both sides of it in the form of thin metal sheets. Sandwich plates are typically 40 to 200 millimeters thick, and the metal sheet, which is most often steel, is approximately 1 millimeter thick.

A generic device for tooling sandwich plates is described in U.S. Pat. No. 4,984,615. The cutting tool of the known device has several cutting elements in the form of cutting knives that are arranged one after another in the cutting direction and are moved in a straight line in that direction. The leading cutting knives in the cutting direction run transverse to the plane of the plate and are inclined to one another in a V shape. A trailing cutting knife that trails the cutting knives inclined to one another is aligned perpendicular to the plane of the plate in the cutting direction. The leading cutting knife cuts a strip of material out of a cover layer of the sandwich plate, which has relatively high mechanical strength, and that way the core of the sandwich plate is cut free. Then the relatively soft core of the sandwich plate is cut through by means of the cutting knife running perpendicular to the plane of the plate.

The disadvantage of the known cutting device is that it allows sandwich plates to be tooled only from the free edge of the plate.

Starting from the state of the art described, the problem of this invention is to expand the ways of tooling sandwich plates separately so the cutting surfaces have at least uniform quality.

SUMMARY OF THE INVENTION

The invention solves this problem, in the case of the type of cutting device mentioned at the beginning, by making the cutting tool a cutting chain with cutting elements in the form of chain links and a chain guide as the guide mechanism, where the chain links, lying one after the other in their direction of movement, are moved relative to one another, so they can swivel on swivel axes running transverse to their plane of movement by means of a chain guide in the plane of movement, sometimes in a straight line, sometimes turned in a curve, and have several cutting teeth one after another in their direction of movement which project radially on the cutting chain and have cutting edges that run transverse to the plane of movement of the chain links, where the perpendicular projections of the cutting edges in the plane of movement are arranged at least partially along a line curved radially to the outside. Because of the features described, the cutting device in the invention has the option of tooling sandwich plates separately from their free edges out or starting from any point on the surface of the plates. Depending on the requirements, it is possible to make the cut go through or not go through. The part of the cutting chain in which the chain links are turned around can go into the sandwich plate to be tooled. If the cutting chain is in contact with the straight guide of the chain links, a smooth cutting front bordering the cutting slit made in the cutting direction is produced. These types of smooth cutting fronts need the peak line on the corner of the cutout where two cutting slits meet to run straight, in the corners of the cutouts on the sandwich plate in question. The design in the invention for the cutting teeth ensures that the different materials in a sandwich plate can be cut by means of the cutting device, with no hooking which would impair the quality of the cutting results. Qualitatively high cutting results are also achieved by the invention's feature whereby the perpendicular projections on the cutting edges are arranged at least partially along a line curved radially to the outside. The curve of said line can be chosen so that all cutting edges of all chain links in the area where they are curved move on one and the same path, but in any case on approximately identical paths.

Experience has shown that good cutting results are achieved when—as is provided in one preferred embodiment of the invention—the radius of curvature of the line, along which the perpendicular projections of the cutting edges are arranged on the chain links in the plane of movement, is 0.8 to 2.5 times the smallest radius of curvature of the path of movement, which the perpendicular projections of the cutting edges describe in the plane of movement for the curved turn of the chain links.

Besides the precautions described already above, a number of measures have been taken on the cutting devices in the invention to guarantee good cutting results.

They can be added or used alternatively. In this sense, one variation of the invention provides that the cutting chain has three adjacent rows of chain links, where the chain links in the two outer rows form outer links and the chain links in the row in the center form center links, and where the adjacent outer links are flush with one another, and the center links are arranged staggered to the outer links in the direction of movement of the chain links and overlap with the outer links, lying one behind the other in their direction of movement and/or that the cutting edges of at least the adjacent outer links are flush with one another and/or that the outer surfaces of the chain or outer links are flat and/or that at least one of the outer surfaces of the chain links or outer links forms a free angle and runs opposite the assigned cutting surface on the sandwich plate and/or that the chain links have at least five cutting teeth respectively and/or that the cutting surfaces of at least some of the center links on the cutting chain project radially opposite the cutting edges of the outer links and/or that the distances between the cutting edges of adjacent cutting teeth on a chain link vary.

On the type of multi-row cutting chains described above, the intermediate space that remains between the cutting teeth, next to one another in the direction of movement, of two outer links following one another in said direction can be closed, if necessary, by means of the cutting teeth of the center link of the cutting chain overlapping with the outer links in question arranged in said intermediate space. Seen in the direction of movement of the cutting links, there is therefore a close sequence of cutting teeth and cutting edges. A flat design of the outer surfaces of the chain links or outer links is used for precise guidance free of unwanted shaking on the cutting surfaces of the sandwich plate being tooled in the cutting direction. The cutting chain is kept from being clamped fast to the sandwich plate,by the free angle set by the invention between the outer surface of the chain links or the outer links of the cutting chain and the cutting surface opposite said surfaces on the sandwich plate. The variation in the distances in the cutting edges of cutting teeth adjacent to one another on a chain link described above makes the cutting chain run quietly and smoothly, allows high cutting and tooling speeds and produces superior quality cutting surfaces.

If the cutting devices in the invention have several rows of cutting links, the outer and center links next to one another, for the sake of simplicity, are connected to one another with connecting bolts, whose axes form the swivel axes on which the chain links lying one behind the other in their direction of movement are able to swivel in relation to one another. Said connecting bolts preferably expand radially into a band in their axial sections assigned to the center links.

In the interest of environmental and worker protection, the cutting dust formed when tooling sandwich plates must be vacuumed up. For this purpose, in the case of one preferred design of the cutting device in the invention, the cutting chain is at least partially enclosed by a drive housing, creating an intermediate space that can be connected to a vacuum device between the cutting chain and the inside wall of the housing.

To guarantee high-quality tooling results, the cutting chain of the cutting device must move precisely in relation to the sandwich plate being tooled. For this purpose, the invention provides for a machine guide, by means of which the basic body of the cutting device, which has the cutting chain for tooling the sandwich plate in question, can be moved and guided relative to it, especially when cutting into the sandwich plate. For example, this prevents the cutting chain or chain guide from tilting when cutting into the sandwich plate.

In one preferred variation of the invention, the machine guide includes a support that can support the sandwich plate being tooled, on which the basic body of the cutting device is mounted so it can move and be guided in relation to the sandwich plate.

One variation of the cutting device in the invention is characterized by the simple kinematics of the relative movement of the basic body of the cutting device in relation to the sandwich plate, in which case the basic body of the cutting device is mounted so it can swivel on the support on an axis running parallel to the plane of the plate.

Another embodiment of the invention is characterized by the fact that the basic body of the cutting device can be moved or swiveled out of a resting position into a working position by means of the machine guide against the effect of a return force. Due to the effect of the return force, the basic body of the cutting device, and with it the cutting chain, automatically moves into a position in which the cutting chain is not in contact with the sandwich plate in question.

To make it easier to use, one preferred design of the invention provides that in the working setting, the basic body of the cutting device can be stopped and preferably locked at various positions, if necessary various swivel positions of the cutting chain and the chain guide relative to the sandwich plate in question. This way, once the right relative position of the cutting chain or chain guide and sandwich plate is set, it stays and the operator of the device does not have to do anything.

In another variation of the cutting device in the invention, there is a support for the machine guide that is designed to be structurally simple and at the same time functional which has a slide for the cutting chain that moves relative to the sandwich plate, and the chain guide.

Besides the cutting device described above, the subject of this invention is also a cutting chain for this type of cutting device. For this, the cutting chain in the invention has chain links as described in claim 19.

BRIEF DESCRIPTION OF THE DRAWINGS

The invention will be described in greater detail below using schematic drawings of one example of embodiment.

DETAILED DESCRIPTION OF THE PREFERRED EMBODIMENT

Figure 1:
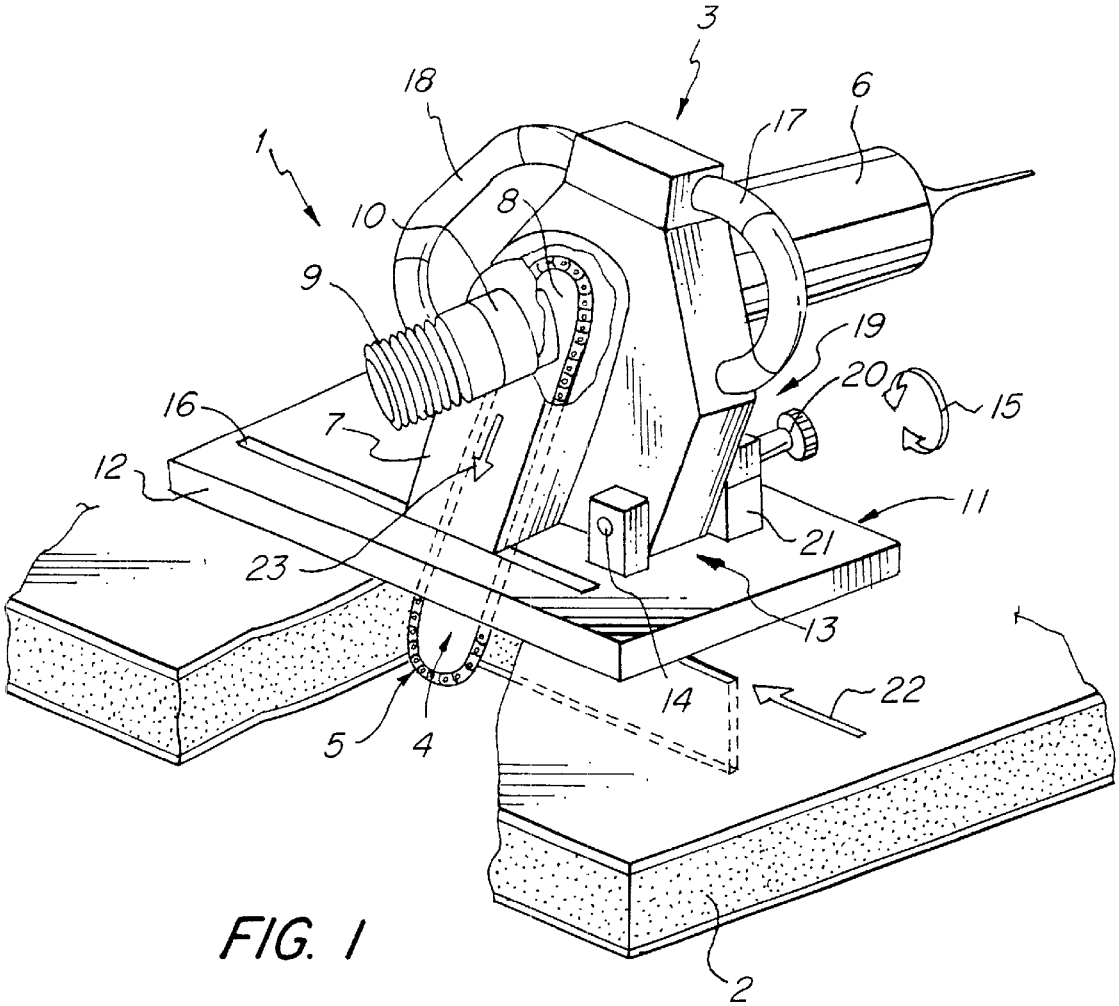
FIG. 1 shows a cutting device with a cutting chain tooling a sandwich plate.

As shown, FIG. 1 includes a cutting device 1 for tooling a sandwich plate 2 and a basic body 3 with a guide rail 4 for an endless cutting chain 5. On both ends of the guide rail 4, the cutting chain 5 turns along a circular track; on the longitudinal sides of the guide rail 4, the cutting chain 5 moves in a straight line. A two-speed electric motor 6 is used to drive the cutting chain 5. On the side facing the electric motor 6, the basic body 3 of the cutting device 1 has a drive housing 7, open in FIG. 1, which surrounds the cutting chain 5, forming an intermediate space 8 between the cutting chain 5 and the housing 7. A suction hose 9 opens into the intermediate space 8 and is attached to it via a connecting support 10 on the housing 7, and is connected with its other end to a vacuum fan.

A machine guide 11 for the cutting device 1 is basically comprised of a supporting plate 12 and a swivel mount 13, by means of which the basic body 3 of the cutting device 1 is connected to the supporting plate 12 so it can swivel on an axis running parallel to the plane of the plate of the sandwich plate 2. The double arrow 15 shows the direction of relative swivel movement of the basic body 3 and the supporting plate 12.

A slot 16 in the supporting plate 12 allows the basic body 3 of the cutting device 1, and with it the cutting chain 5, to swivel back and forth between the working position in FIG. 1 and a resting position in which the cutting chain 5 is not in contact with the sandwich plate 2. To execute this swivel movement, the operator of the cutting device 1 has handles 17, 18 on the basic body 3. When the basic body 3 swivels with the cutting chain 5 from the resting position into the working position, an elastic counter force must be overcome, which is applied by a torsion spring in the swivel mount 13 that is deformed when the swivel movement in question is executed and is not shown in greater detail here. In the working position, the basic body 3 of the cutting device 1 can be stopped opposite the supporting plate 12, and thus with different swivel positions of the cutting chain 5 and the guide rail 4 opposite the sandwich plate 2. A catch device 19 is used for this. It includes a plurality of catch openings on the basic body 3 of the cutting device 1, as well as a catch pin 20 that can be stopped, moved against the spring force in the axial direction and held on a mounting block 21 of the swivel mount 13 connected to the supporting plate 12 so it can move in the axial direction. The snap openings are on the side of the basic body 3 facing away from the viewer in FIG. 1 and are arranged one behind the other in the direction of the swivel movement of the basic body 3. Depending on the desired inclination of the guide rail 4 with the cutting chain 5 opposite the supporting plate 12, the operator of the cutting device 1 snaps the stop pins 20 into one of the snap openings.

Before the relationships shown in FIG. 1 occurred, the basic body 3 had been swiveled counterclockwise on its axis 14, with the electric motor 6 turned on, from a resting position in which the cutting chain 5 and the chain guide 4 were on the side of the supporting plate 12 facing away from the sandwich plate 2. During this swivel movement, the cutting chain 5 came to be supported by the slot 16 in the supporting plate 12 on the surface of the sandwich plate 2. As a result of continued swivel movement, the cutting chain 5 cut into the sandwich plate 2 until finally, at the end of the swivel movement with the guide rail 4, as shown in FIG. 1, it was inclined against the sandwich plate 2. Then the cutting device 1 was pushed smoothly by the operator in the cutting direction, namely in the direction of arrow 22, onto the sandwich plate 2, and that way a separating slot was made in the sandwich plate 2 which had its outlet inside the surface of the sandwich plate 2. During the whole tooling process, the cutting chain 5 was turning in the direction of movement shown by arrow 23. When the sandwich plate 2 was tooled, the cutting chain 5 cut through the different layers of the sandwich plate 2. The cutting dust formed thereby was sucked into the intermediate space 8 between the cutting chain 5 and the housing 7 and from there was carried out through the suction hose 9. The supporting plate 12 was used to protect the operator from the turning cutting chain 5.

Figure 2:
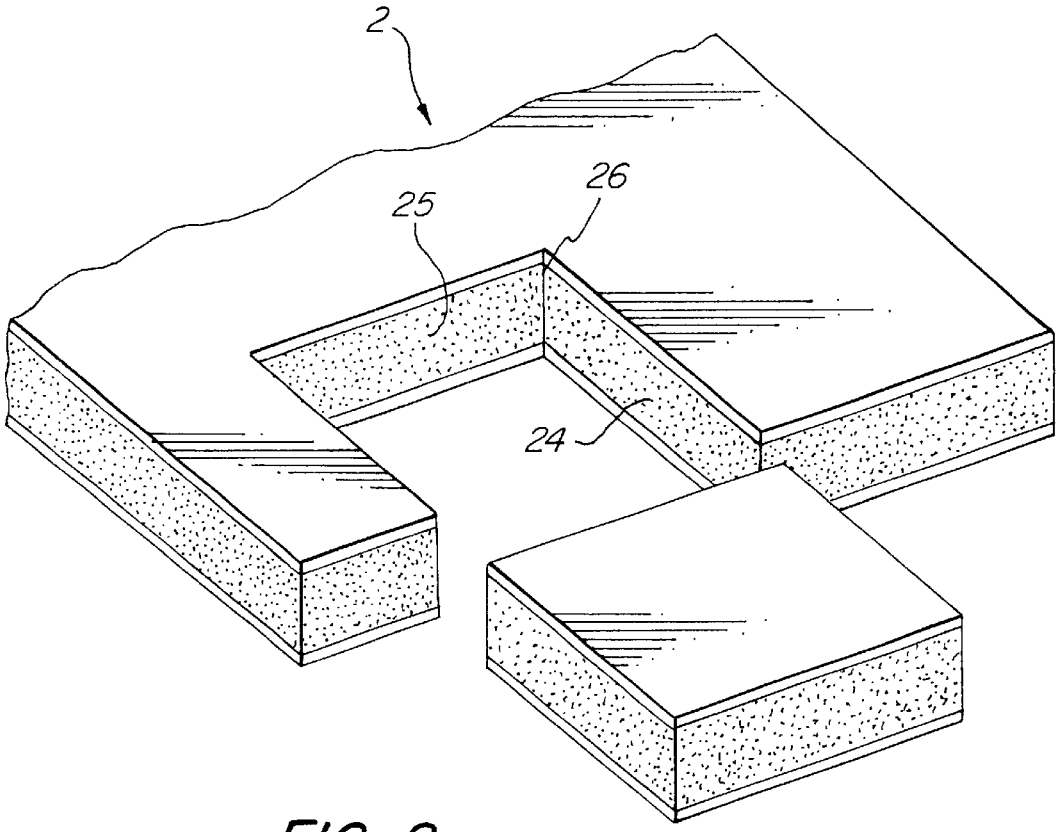
FIG. 2 shows the sandwich plate in FIG. 1 after more tooling with the cutting device in FIG. 1.

Another way of tooling the sandwich plate 2 with the cutting device 1 is shown in FIG. 2. In this case, the cutting device 1 with the supporting plate 12 was set on the sandwich plate 2 with the guide rail 4 for the cutting chain 5 pointing down perpendicular to the sandwich plate 2, and then going out from the free edge of the sandwich plate 2, a separating slot bordered, inter alia, by a cutting surface 24 was formed. Since the cutting chain 5 with the area made straight on the guide rail 4 was in contact with the sandwich plate 2, a flat surface was produced as the front surface bordering the separating slot in the cutting direction. A second separating slot was produced after the production of the first separating slot in a corresponding way, and it extended parallel to the first, starting from the, free edge of the sandwich plate 2. After that, the cutting device was turned 90° on an axis running parallel to the plane of the plate of the sandwich plate 2 and joined with the cutting chain 5 in the resting position between the inner end of the separating slot already made. Then the cutting chain 5 cut into the sandwich plate 2, and the basic body 3 of the cutting device 1 swiveled accordingly. As soon as the guide rail 4 was aligned perpendicular to the plane of the plate of the sandwich plate 2, the cutting device 1 was pushed parallel to the free edge of the sandwich plate 2, starting from the undercut made, and in that way a separating slot was free-cut that runs perpendicular to the first two separating slots made. Cutting surface 25 thereby formed one of the surfaces running in the cutting direction bordering the first separating slot made. Also, the front surface of this cutting slot was straight. As a result of this, at the places where the separating slots running transverse to one another meet, there were cutout corners with straight peak lines, one peak line 26 of which can be seen in FIG. 2. Because of the alignment of the guide rail 4 that was chosen, the cutting surfaces 24, 25 made and the cutting surface opposite cutting surface 24, not visible in FIG. 2, and cutting surface 25 run perpendicular to one another and perpendicular to the plane of the plate of the sandwich plate 2.

Figure 3:
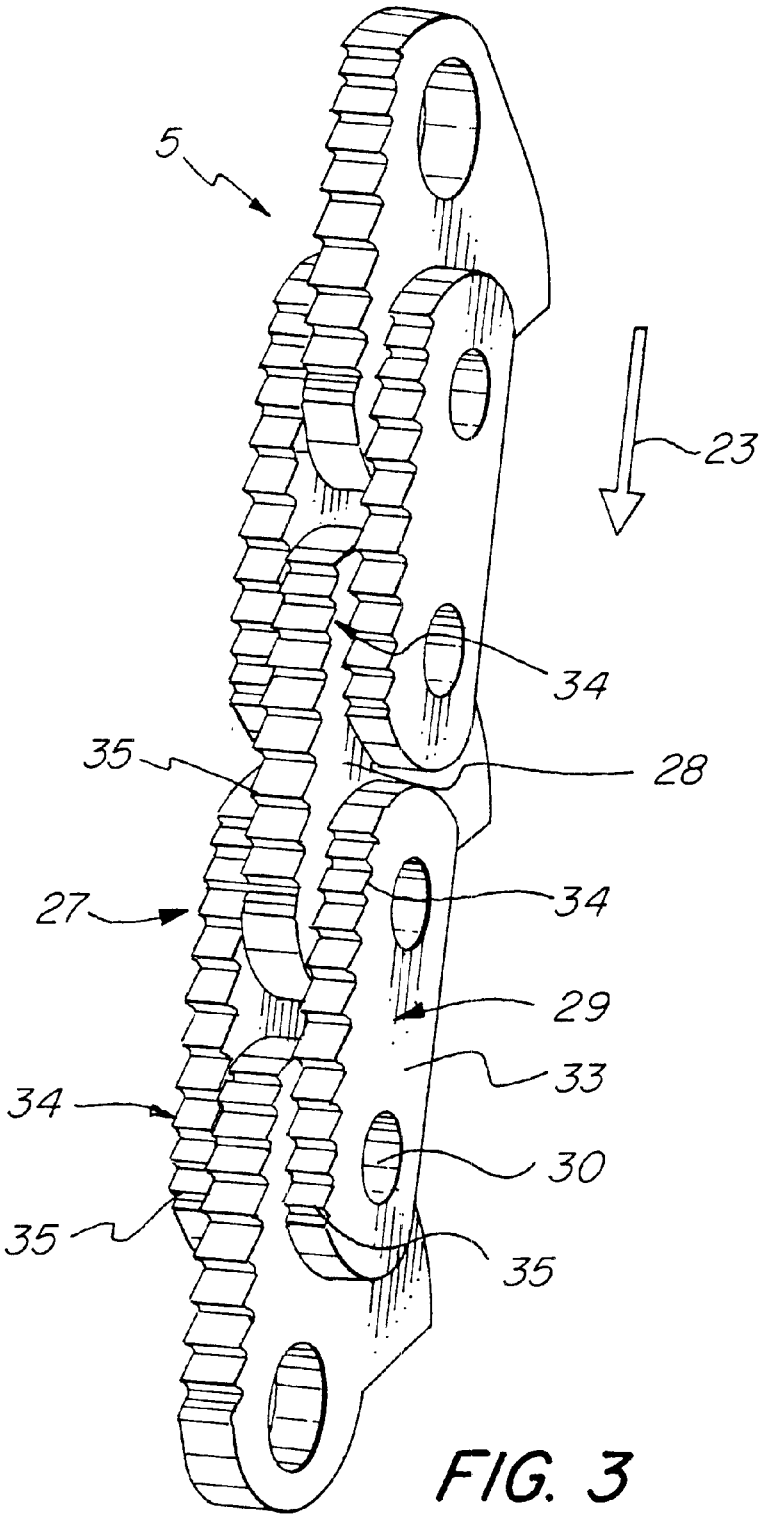
FIG. 3 shows a cutout from the straight part of the cutting chain in FIG. 1.
Figure 5:
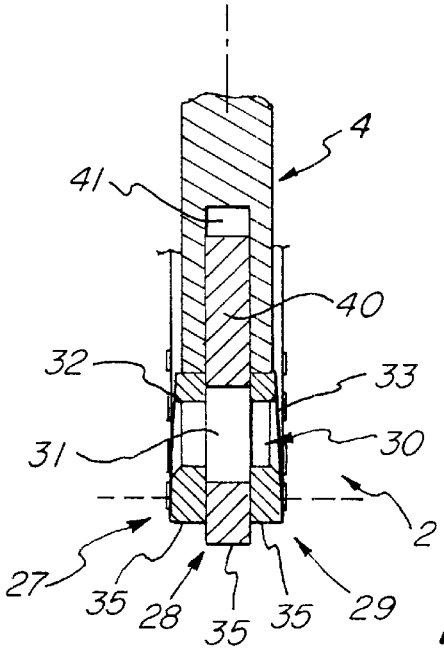
FIG. 5 shows an enlarged cross section along line V—V in FIG. 4.

In FIG. 3, the cutting chain 5 has three rows of chain links 27, 28, 29 next to one another. In this way, chain links 27, 29 form outer links that coincide with one another, and chain links 28 form the center links of the cutting chain 5. The adjacent outer links 27, 29 are flush with one another; the center links 28 are staggered in the direction of movement 23 of the cutting chain 5, hence chain links 27, 28, 29 opposite outer links 27, 29. Each center link 28 overlaps with two outer links 27, 29 on the two outer rows of chain links; the two outer links lie one after another in the direction of movement 2. Chain links 27, 28, 29 are connected by connecting bolts 30. As can be seen especially in FIG. 5, each connecting bolt 30 goes through two adjacent outer links 27, 29 and the center link 28 between them. In their axial sections assigned to the center links 28, the connecting bolts 30 expand radially into a band 31. FIG. 5 shows in dots and dashes the central plane of the guide rail 4, which defines the course of the parallel planes of movement of the chain links 27, 28, 29 of the rows of chain links or the cutting chain 5. The outer surfaces 32, 33 of the outer links 27, 29 are even. The axial front surfaces of the connecting bolts 30 are flush with surfaces 32, 33 of outer links 27, 29.

The connecting bolts 30 form the swivel axes on which chain links 27, 28, 29, one after another in their direction of movement 23 can be swiveled in relation to one another. Cutting teeth 34 in the form of saw teeth project radially on the chain links 27, 28, 29 and have cutting edges 35 that run crosswise to the planes of movement of chain links 27, 28, 29 and extend over the whole width of chain links 27, 28, 29. The cutting edges 35 of the center links 28 project, roughly 0.7 mm on the cutting chain 5 opposite cutting edges 35 of the outer links 27, 29 in the radial direction.

Figure 6:
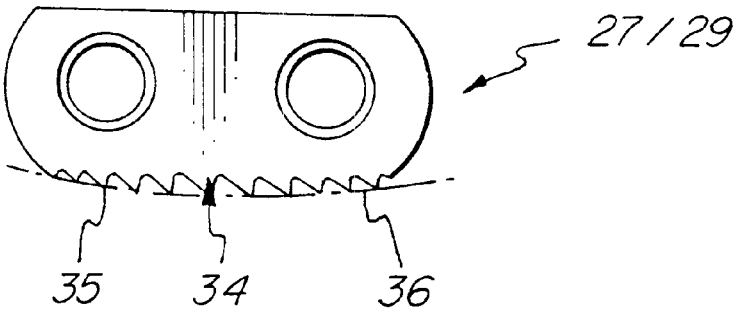
FIGS. 6 and 7 show chain links on the cutting chain in FIGS. 1 and 3 to 5 in individual views.
Figure 7:
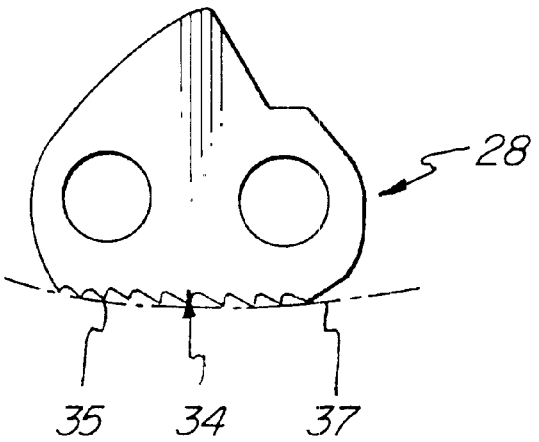

As can be inferred especially from FIGS. 6 and 7, the perpendicular projections of the cutting edges 35 in the plane of movement and on the outer links 27, 29 and also on the center links 28 are arranged along a line 36, 37 curved radially to the outside. In their radius of curvature, lines 36, 37 coincide with one another. The distances between the cutting edges 35 adjacent to one another along lines 36, 37 vary just like the depth of the gaps between the cutting teeth 34 in question.

Figure 4:
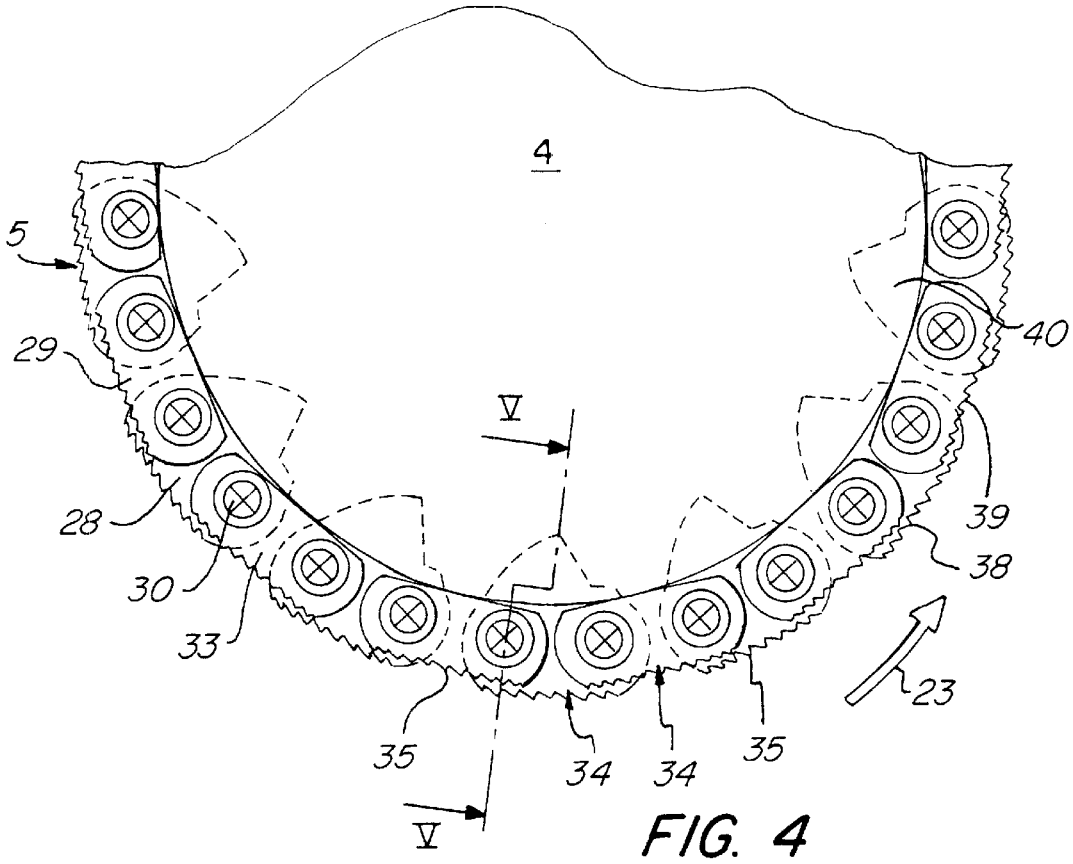
FIG. 4 shows a cutout from the area near the lower turn of the cutting chain in FIG. 1.

In FIG. 4, the arrangement of the cutting edges 35 on the outer links 27, 29 and on the center links 28 along lines 36, 37 requires that the cutting edges 35 on the outer links 27, 29, in the area where the cutting chain 5 turns describe one and the same path of movement as the cutting edges 35 of the center links 28. The paths of movement of the cutting edges 35 on the outer links and on the center links are shown in dashes in FIG. 4 and marked with reference numbers 38, 39. They run concentrically with a curve that corresponds to the curves in lines 36, 37 which coincide with one another.

FIG. 4 also shows guide stops 40 on: the center links 28, by means of which the cutting chain 5 goes into a guide groove 4:1 on the guide rail 4 (FIG. 5) in the direction of movement 23. The outer links 27, 29 are supported with straight basic surfaces on the guide surfaces of the guide rail 4 adjacent to guide groove 41.

As an alternative to the relationships shown, a chain wheel can also be used to turn the cutting chain 5.

According to FIG. 5, the total width of the cutting chain 5 decreases as the distance from the cutting edges 35 of the outer links 27, 29 and the center links 28 increases. As a result, there is a free angle α between the outer surfaces 32, 33 of the outer links 27, 29 and the cutting surface of the sandwich plate 2 shown in dashes in FIG. 5 on both sides of the cutting chain 5.

Having thus described the invention, what is claimed is:

1. A cutting device for cutting a sandwich plate (2) and having a housing (3) with a support plate (12) and a motor-driven cutting tool (5) rotatably supported in a guide mechanism in the housing to move in a cutting direction and cut through the sandwich plate (2), said cutting tool having cutting elements that move together in a common path of movement extending transversely of the plate on said support plate (12), wherein said cutting tool is an endless cutting chain (5) with said cutting elements comprising chain links (27, 28, 29) arranged in three adjacent rows comprising a middle row and two outer rows and wherein said guide mechanism is a chain guide (4), said chain links (27, 28, 29) being pivotably coupled so that adjacent links in the path of movement (23) of said chain can pivot relative to one another on pivot axes extending transversely of the path of movement, each of said links in each of said rows having several cutting teeth (34) which project in a radial direction on the cutting chain (5) and have cutting edges (35) which extend in a direction transversely of the path of movement of the chain links (27, 28, 29), said links having leading and trailing ends in the path of movement of said chain, said cutting edges (35) of the teeth in each link lie along an imaginary line (36, 37) curved radially outwardly of said cutting chain, and the links (28) of said middle row have their leading and trailing ends in the path of movement (23) overlapping the ends of the trailing and leading ends of the links (27, 29) of said outer rows, the adjacent links in the three rows of the chain are pivotably connected to one another by connecting bolts (30) which extend through one end portion of said outer rows and one end portion of the link of said middle row.

2. The cutting device in claim 1 wherein said imaginary line (36, 37) along which said cutting edges (35) on the chain links (27, 28, 29) lie in the path of movement has a radius of curvature which varies in length as the endless chain moves in the path between changes in direction, said radius of curvature between the changes in the direction being 0.08 to 2.5 times the smallest radius of curvature of the endless chain as said chain changes direction in said path of movement.

3. The cutting device in claim 1 wherein the connecting bolts (30) have a radially enlarged portion (31) received in said links (28) of said middle row.

4. The cutting device in claim 1 wherein the links (27, 29) of the outer rows have their ends aligned and wherein the cutting edges (35) of the links (27, 29) of the outer rows lie in a common curved plane.

5. The cutting device in claim 1 wherein said links of each of said outer rows have outer side surfaces and inner side surfaces adjacent said middle row, said outer side surfaces (32, 33) of the links (27, 29) of each of said outer rows lying in common rectilinear planes and said inner side surface of each of said outer rows lying in common rectilinear planes.

6. The cutting device in claim 5 wherein said planes of said outer side surfaces (32, 33) of said outer links (27, 29) extend inwardly from said cutting edges of said outer links to provide a reduced width for the chain at a point spaced inwardly from said cutting edges of said outer links.

7. The cutting device in claim 1 wherein the chain links (27, 28, 29) each have at least five cutting teeth (34).

8. The cutting device in claim 1 wherein the cutting edges (35) of at least some of the links (28) of the middle row extend in the radial direction outwardly of the cutting edges (35) of the links (27, 29) of the outer rows.

9. The cutting device in claim 1 wherein the cutting edges of said teeth of each link are spaced apart and the spacing between said cutting edges varies on at least some of said chain links (27, 28, 29).

10. The cutting device in claim 1 wherein the cutting chain (5) and chain guide (4) are at least partially surrounded by a drive chain housing (7) with an inside wall and wherein an intermediate chamber (8) is formed between the cutting chain (5) and said inside wall of said drive chain housing (7), and wherein said housing (3) includes means for connecting said chamber (8) to a suction device to draw waste away from the sandwich plate.

11. The cutting device in claim 1 wherein said support plate (12) provides a machine guide (11) for the housing (3) for movement of the cutting device along an upper surface of the sandwich plate (2) during cutting of the sandwich plate (2).

12. The cutting device in claim 1 wherein said support plate (12) can be supported on the sandwich plate (2) being cut and upon which said housing (3) of the cutting device (1) is movably mounted so that an axis of a plane in which the cutting chain moves relative to a plane of an upper surface of the sandwich plate (2) can be adjusted relative to the plane of the upper surface of the sandwich plate (2).

13. The cutting device in claim 1 wherein the housing (3) of the cutting device (1) is mounted on the support plate (12) so that said housing can pivot about an axis (14) extending parallel to a plane of an upper surface of the sandwich plate.

14. The cutting device in claim 1 wherein said housing (3) of the cutting device (1) can be releasably locked at various angular positions of the cutting chain (5) and the chain guide (4) relative to said support plate (12) and the sandwich plate (2).

15. The cutting device in claim 1 wherein said support plate (12) has a slot (16) in which the cutting chain (5) and the chain guide (4) are movable in relation to the sandwich plate (2).

16. The cutting device in claim 1 wherein the chain guide (4) is elongated with a linear central portion and arcuate end portions and said cutting chain (5) moves thereabout.

* * * * *